US006446281B1

(12) United States Patent
Kim

(10) Patent No.: US 6,446,281 B1
(45) Date of Patent: Sep. 10, 2002

(54) WATER SUPPLY OPERATED BY A FOOT

(75) Inventor: Yeae Kim, Seoul (KR)

(73) Assignee: Sunjin Marketing, Inc., Seoul (KR)

( * ) Notice: Subject to any disclaimer, the term of this patent is extended or adjusted under 35 U.S.C. 154(b) by 0 days.

(21) Appl. No.: 09/701,505

(22) PCT Filed: Mar. 31, 2000

(86) PCT No.: PCT/KR00/00292

§ 371 (c)(1),
(2), (4) Date: Nov. 30, 2000

(87) PCT Pub. No.: WO00/60181

PCT Pub. Date: Oct. 12, 2000

(30) Foreign Application Priority Data

Apr. 1, 1999 (KR) ..... 99-11444

(51) Int. Cl.[7] ..... F16K 31/62
(52) U.S. Cl. ..... 4/677; 4/675; 251/295
(58) Field of Search ..... 4/675, 676, 677; 251/295, 296

(56) References Cited

U.S. PATENT DOCUMENTS 2,188,258 A * 1/1940 Zinkil et al. ..... 251/295 X

FOREIGN PATENT DOCUMENTS

FR 2534348 * 4/1984 ..... 4/675

* cited by examiner

*Primary Examiner*—Robert M. Fetsuga
(74) *Attorney, Agent, or Firm*—Morrison & Foerster LLP

(57) ABSTRACT

Disclosed is a water supply operated by a foot, in which the type or water such as warm or cold water is selected and the flow rate of water is regulated by operation of a foot. The water supply (53) has a ceramic cartridge inserted at the inside of the water supply and lever (91) fixed with operating pedal (54) whose upper plate has constant thickness when the cartridge is laid horizontally. According to a degree to push the pedal toward "A" portion, the flow rate of water supply is regulated, and according, to selection of "C" or "D" portion of the pedal, warm or cold water is selected. Thus, since the water supply is operated by a foot, it facilitates its use.

3 Claims, 8 Drawing Sheets

WATER SUPPLY OPERATED BY A FOOT

TECHNICAL FIELD

The present invention relates to a water supply operated by a foot, more particularly, to a water supply operated by a foot, in which the type of water such as warm or cold water is selected and the flow rate of water is regulated by operation of a foot.

BACKGROUND ART

There has been a way of opening/closing the valve of faucet, in which one press a footboard to thereby be operated by not only a hand but a foot and another way, in which the valve of faucet itself is set as an electro-magnetic valve to thereby be controlled electro-magnetically. An electro-magnetic water supply comprising on/off way by detecting a hand on faucet has been commonly used and the on/off way of faucet opens/closes according to the state of approaching hand by using ultraviolet ray detecting sensor.

However, a conventional foot-response switchgear of faucet is lack of delicacy in controlling, which users have complained about and a conventional switchgear of faucet applied electromagnetic valve is relatively delicate in operation but problematic in that often breakdowns, leading to decrease in consumption. An electromagnetic water supply by using ultraviolet ray detecting sensor is also problematic in that one should use a hand.

Therefore, a demand for a water supply, in which the type of water such as warm or old water and the flow rate of water is regulated more delicately with less breakdown, has been increasing

DISCLOSURE OF THEE INVENTION

Accordingly, the present invention has been made keeping in mind the above problems occurring in the prior art, and an object of the present invention is to provide a delicate and simple water supply, in which the type of water such as warm or cold water is selected and the flow rate of water is regulated by a foot position detecting sensor and warm or cold water is selected and the flow rate of water is determined according to a foot position of user and an opening/closing angle of faucet is regulated according to the determined signal.

Another object of the present invention is to provide, under an identical structure of conventional water supply, a water supply, in which a controlling part, allowing to be operated by a foot, is placed at the bottom.

In order to accomplish the above object, the present invention provides a foot position detecting sensor, in which a foot position is detected to thereby warm or cold water and the flow rate of water be determined accord g to a foot position of a user; controlling part, in which a value of foot position detected by the foot position detecting sensor is calculated and a signal is outputted; warm or cold water valve actuator, in which the warm or cold water valve is opened/closed according to the outputted signal; and a foot position detecting sensor, in which heat detecting sensor is used.

In order to accomplish another object, the present invention provides a sink water supply, in which as warm or cold water is selected by rotating regulating bar in left/right direction and the flow rate of water is regulated according to pushing degree of the regulating bar, and main body of the sink water supply is moved to the lower part of the sink and outputting pipe is lengthened to thereby be placed over the sink. The regulating part has similar shape to the fore part of shoes, to thereby facilitate foot movement.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Hereinafter, an explanation on a water supply operated by a foot according to the present invention will be in detail discussed with reference to FIGS. 1 to 7*c*.

Figure 1:
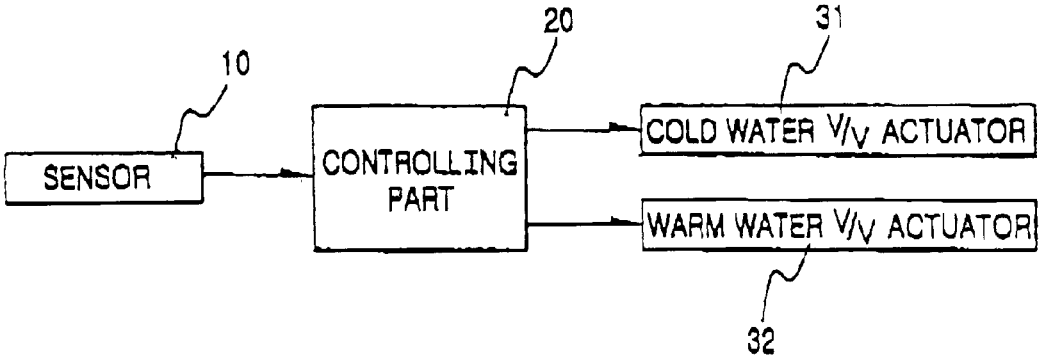
FIG. 1 is a block view according to an embodiment 1 of the present invention.

A water supply operated by a foot according to an embodiment of the present invention comprises, as shown in FIG. 1, a foot position detecting sensor 10, in which a foot position is detected to thereby warm or cold water and the flow rate of water be determined according to a foot position of user; controlling part 20, in which a value of foot position detected by the foot position detecting sensor 10 is calculated and a signal is outputted; a cold water valve actuator 31, in which the cold water valve is opened/closed according to the outputted signal from the controlling part 20; and a warm water valve actuator 32, in which the warm water valve is opened/closed according to the outputted signal from the controlling part 20.

Figure 2:
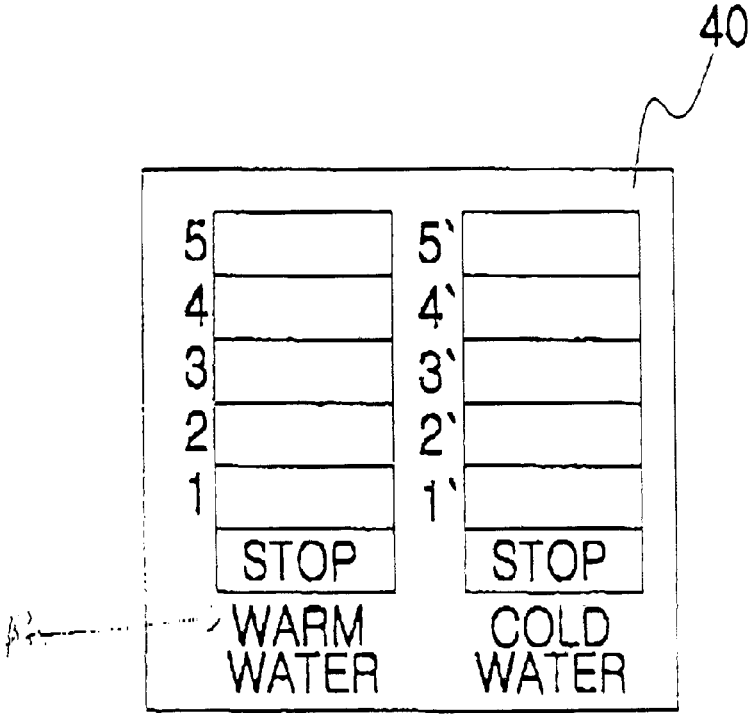
FIG. 2 is a perspective view showing a water supply to embody the present invention.

The foot position detecting sensor 10 uses heat detecting sensor or light detecting sensor. As shown in FIG. 2, at each steps (stop, 1, 2, 3, 4 and 5) of a flow rate of warm water and at each steps (stop, 1', 2', 3', 4' and 5') of a flow rate of cold water, once a user place one's foot on the sensor, it detects the radiating heat and distinguish the flow rate of warm or cold water which a user wants to use.

An embodiment 1 according to the present invention is described as follows.

In order to select warm or cold water, a foot is placed to pertinent step of operation plate 40. In case user wants to be provided lukewarm water with intermediate flow rate, a foot is placed to step 3' of warm water and cold water respectively. In controlling part 20, the outputted signal from the foot position detecting sensor 10 is distinguished to determine the flow rate of warm or cold water and then output a opening/closing signal to cold water valve actuator 31 and warm water valve actuator 32 respectively. In the meantime, when the user wants to use only cold water, the foot can be placed to step 'stop' of warm water, to thereby only cold water is operated and in the same way, to use only warm water, the foot can be placed to step 'stop' of cold water, to thereby only warm water is operated.

It is, of course, possible to regulate the flow rate according to each step. When a user wants to be provided a small amount of water, it can be regulated by selecting step 1 or 1' of warm or cold water and, in case of a large amount of water, it can be regulated by selecting step 5 or 5' of warm or cold water.

An embodiment 2 according to the present invention comprising a water supply operated by a foot through a mechanical modification, besides the above electromagnetic method, is explained below with reference to FIG. 3.

Figure 3:
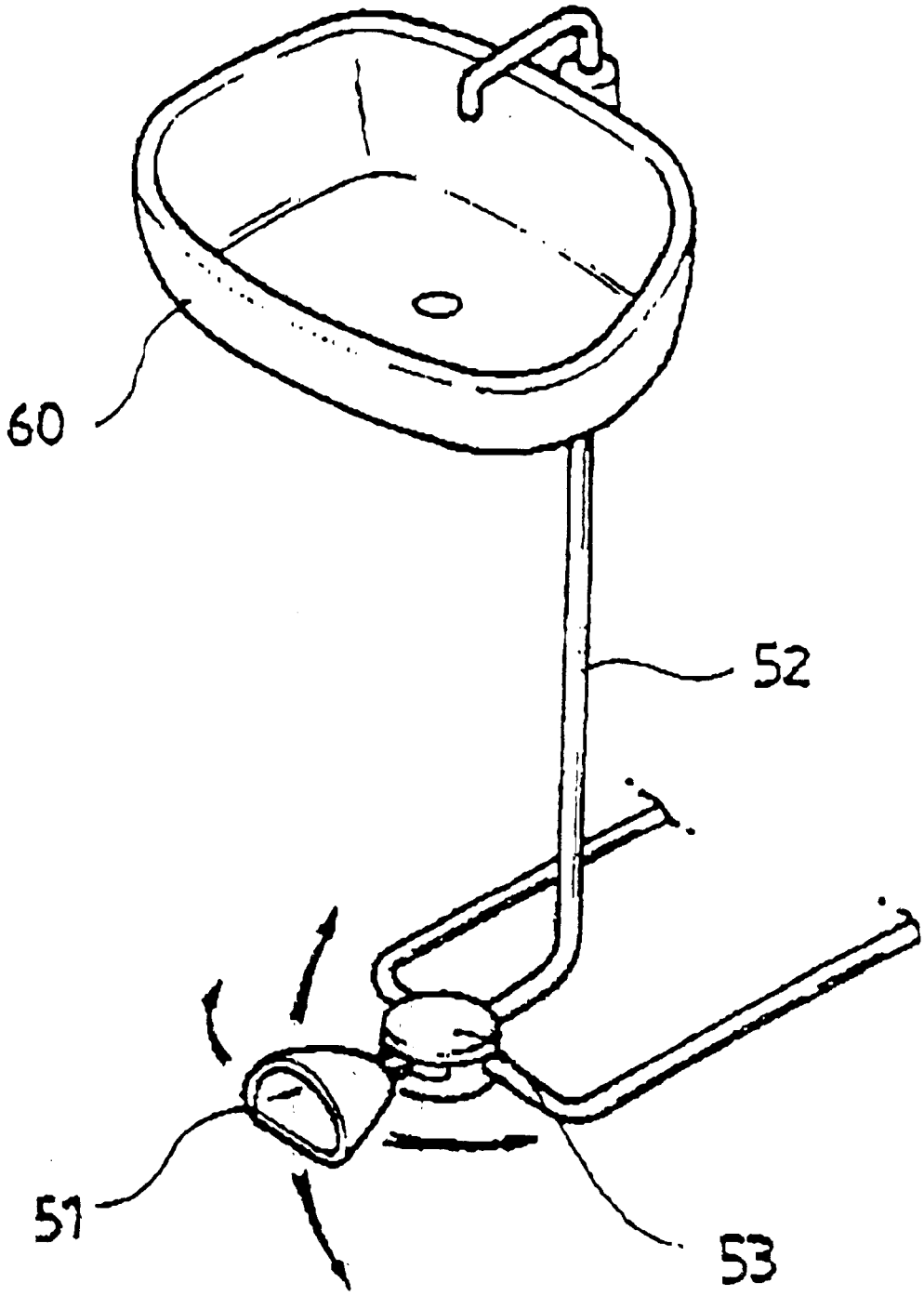
FIG. 3 is a perspective view showing a water supply according to an embodiment 2 of the present invention.

As shown in FIG. 3, a water supply operated by a foot comprises regulating bar 51, which rotates in left/right direction and move vertically; a water supply 53, in which warm or cold water is selected according to a rotating state of the regulating bar 51 and the flow rate of water is regulated according to vertical movement of the regulating bar 51; and outputting pipe 52, in which water is outputted according to a state of opening/closing of warm/cold water valve.

The regulating bar 31 is formed in the similar shape of the fore part of shoes to thereby, facilitate to put a foot in and be moved left/right and up/down.

Figure 4:
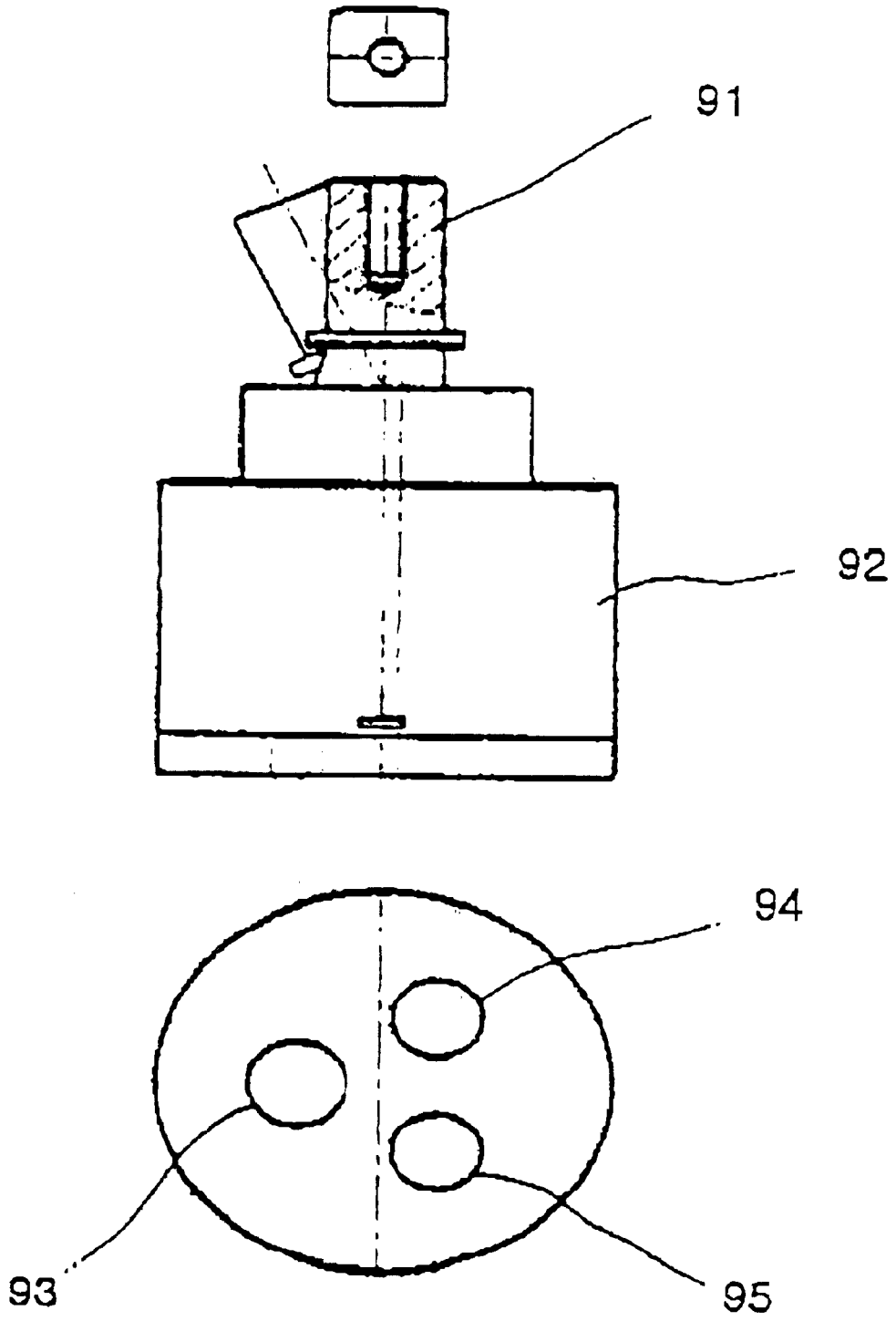
FIG. 4 is a cross-sectional view showing a ceramic cartridge inserted at the inside of a water supply of the present invention.

A ceramic cartridge, shown in FIG. 4, is inserted in an inner part of the water supply 53. The main body of the ceramic cartridge 92 comprises warm/cold water inputting openings 94, 95; water inputting opening 93, through which water is outputted to outputting pipe 52 according to the flow rate of water inputted from the warm/cold inputting openings 94, 95; and lever 91, acting as a handle for selecting warm/cold water based on the degree of opening/closing of the valve between the warm/cold inputting openings 94, 95 and water outputting opening 93.

Operation of the supply is described in the following.

In case a user wants to be provided a large amount of cold water, a foot is put into the regulating bar 51 and the foot is moved to the left side and then, the regulating bar 51 is lowered. According to the movement of the lever 91 of the ceramic cartridge 92, the cold water inputting opening 95 is largely opened and cold water is outputted. In case a user wants. to be provided a large amount movement of the lever 91 of the ceramic cartridge 92, the warm water inputting opening 94 is largely opened and warm water is outputted.

If a user wants to use warm and cold water together, a foot is placed in the middle when the foot is put into the regulating bar 51 and then the regulating bar 51 is lowered. The warm/cold water inputting opening 94, 95 on the lever 91 of the ceramic cartridge 92 are half-opened respectively and mixed warm/cold water is outputted.

If a user wants to stop the water supply, the regulating bar 51 is lifted and according to movement of the lever 91, the warm/cold water inputting opening 94, 95 is closed completely and the water supply is stopped.

As above explained, the water supply is operated by a foot in the same manner of conventional water supply with a hand operation, to thereby facilitate to operate.

In embodiment 3, the ceramic cartridge 92 of embodiment 2 is used in the state of laying down horizontally and regulating bar 51 is not in the shape of shoes but a pedal-way.

Figure 5:
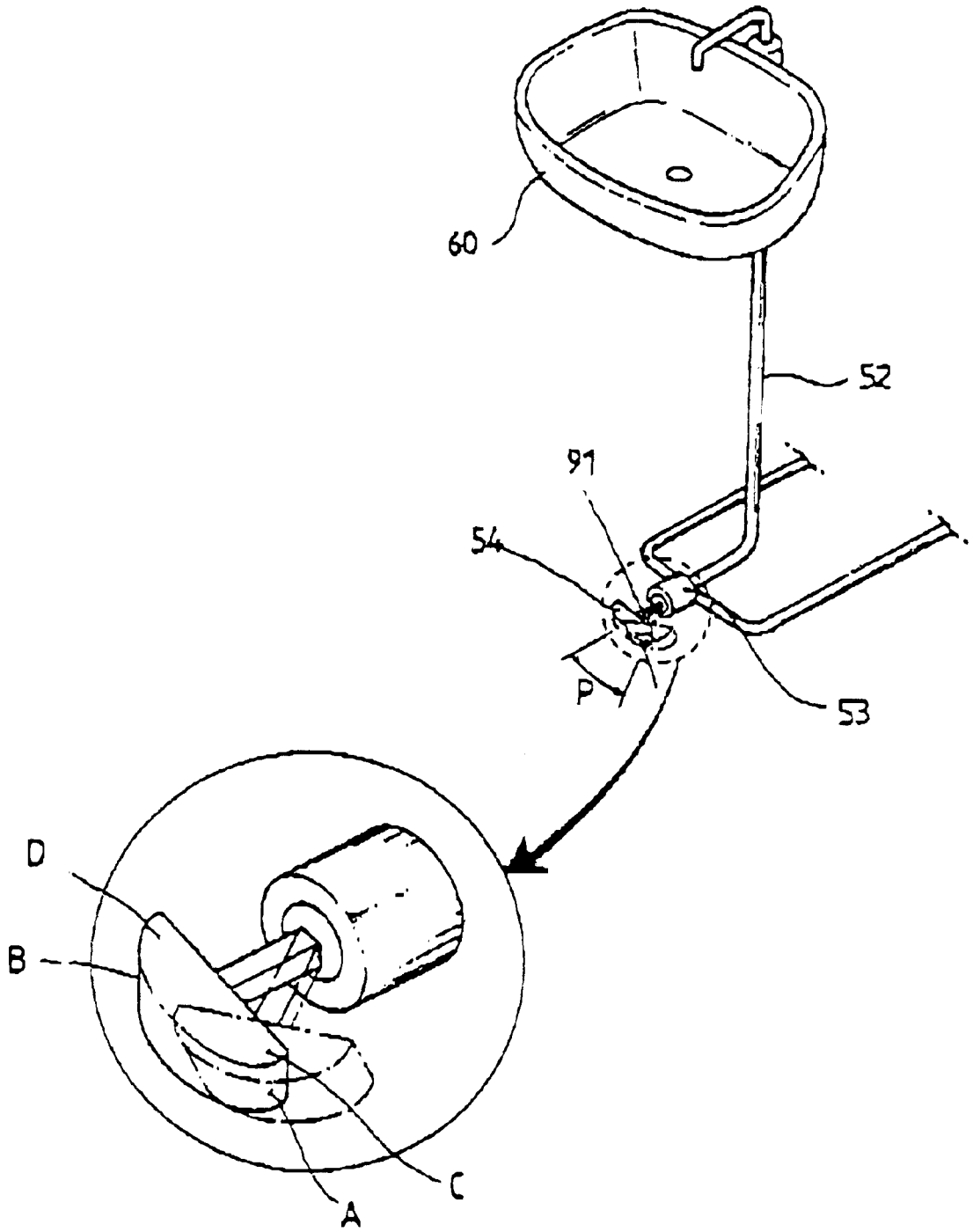
FIG. 5 is a perspective view showing a water supply, in which a shoes-shaped regulating bar is modified to pedal-way and ceramic cartridge is lied horizontally according to an embodiment 3 of the present invention.
Figure 6:
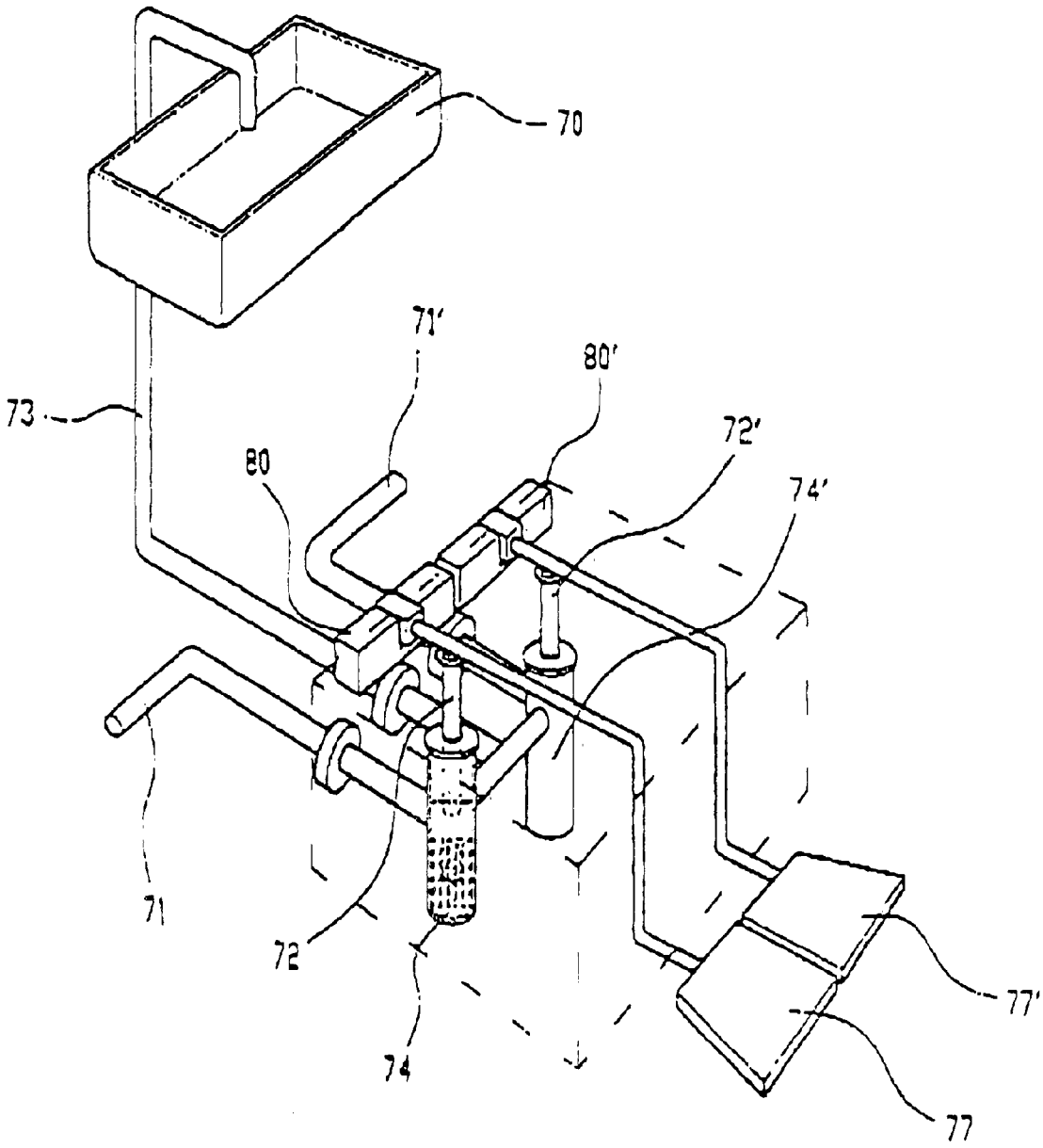
FIG. 6 is a perspective view showing a water supply according to an embodiment 4 of the present invention.

As shown in FIG. 5, embodiment 3 comprises in the same way of embodiment 2 except that the main body of ceramic cartridge 92 is laid horizontally.

Operating pedal 54 is fixed to the lock lever 91 to thereby, the lever 91 protruded from the middle of main body 92 be operated.

When a user presses 'D' portion of the operating pedal 54 by using the operating pedal 54, the lever 91 is rotated and warm or cold water is selected. When the lever 91 is moved to the extent of 'P' by pushing 'A' portion of operating pedal 54, valve of inner part of the ceramic cartridge 92 is opened and water is outputted.

In order to stop the water supply, 'B' portion of operating pedal 54 is pushed to original position and the valve of inner part of the ceramic cartridge 92 is closed and the supply is stopped.

If a user wants to select and use warm water, warm water will be outputted by pressing 'C' portion and pushing 'A' portion of the operating pedal 54.

If a user wants to use warm and cold water together, mixed water is outputted when 'D' portion and 'C' portion of the operating pedal 54 are regulated. without the operating pedal 54 slanting any side, and 'A' portion is pushed.

A water supply according to embodiment 4, as shown in FIGS. 6, 7*a*, 7*b* and 7*c*, comprises an outputting pipe 73 arranged on a sink 70; warm/cold water inputting pipe 71, 71', in which water is flowed to thereby water be spewed out to the outputting pipe 73; cylinder 74, 74' and piston 72, 72', playing a role as a valve for controlling the flow rate between the inputting pipe 71, 71' and outputting pipe 73; plunger 75, in which opening/closing of flowing water from inputting pipe 71 to outputting pipe 73 by peristaltic movement according to vertical movement of the piston 72, 72', is practically controlled; footboard 77, 77' which is linked to the end of a lever 78, to thereby operate lever 78, in which the vertical movement of the piston 72, 72' is controlled; a hinge 79, in which the lever 78 is rotated in a fixed degree around a fixed bar 80, 80' according to the movement of the footboard 77, 77'; and a spring 76 which is equipped at the lower part of the plunger 75, to thereby the plunger 75 to prohibit from spewing out water when returning to the original state without pressing the footboard 77,77'.

The footboard 77, 77' is manufactured to be positioned closest each other so that two can be pressed at once.

There is described the operation of the above explained water supply in detail. The footboard 77 is explained for warm water and the footboard 77' is explained for cold water.

If a user wants to use warm water, the footboard 77 is pressed, to thereby the piston 72, which is lined to the lever 7S, be lowered.

Figure 7A:
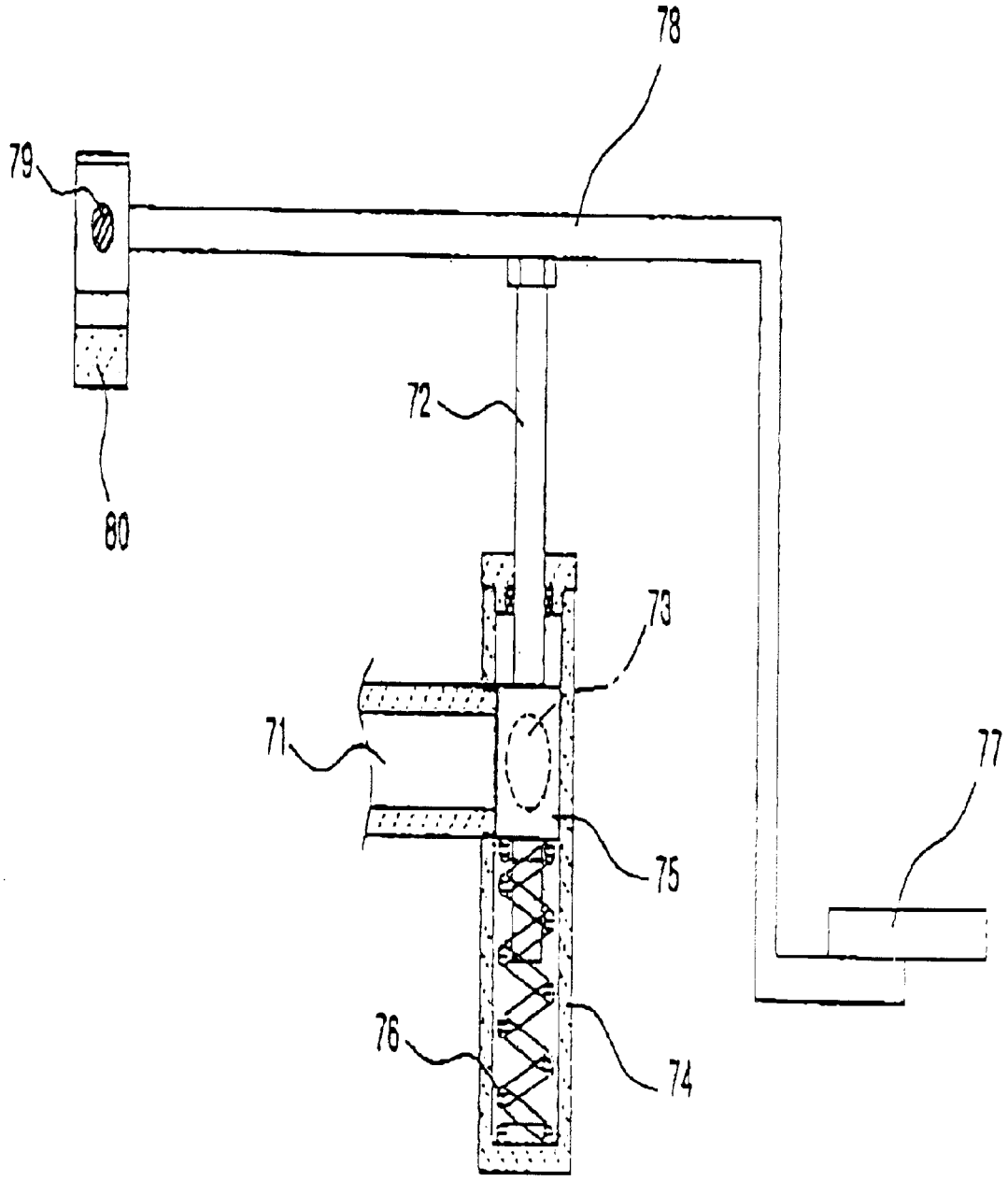
FIGS. 7*a*, 7*b*, and 7*c* are enlarged cross-sectional views showing a water supply according to an embodiment 4 of the present invention.
Figure 7B:
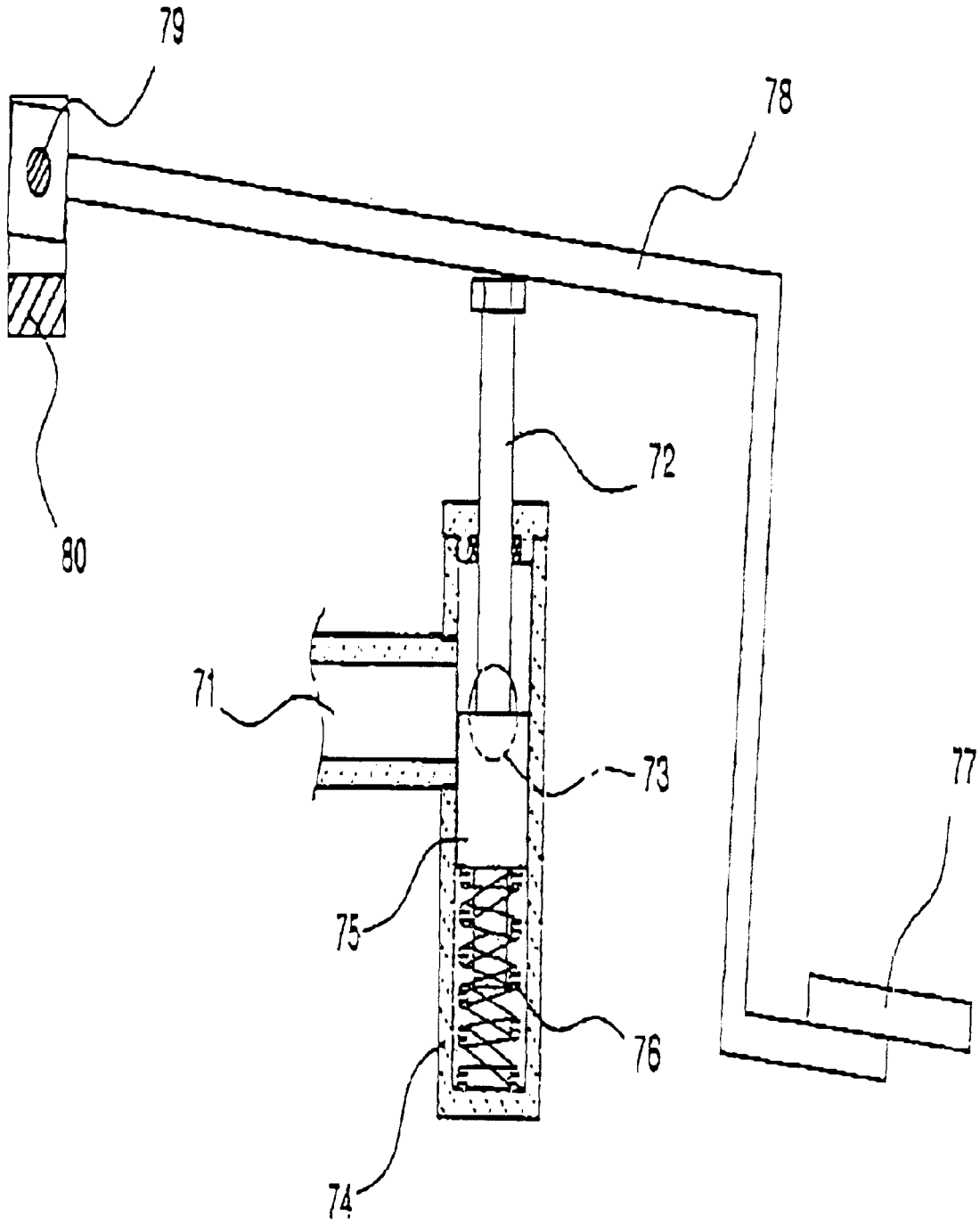
Figure 7C:
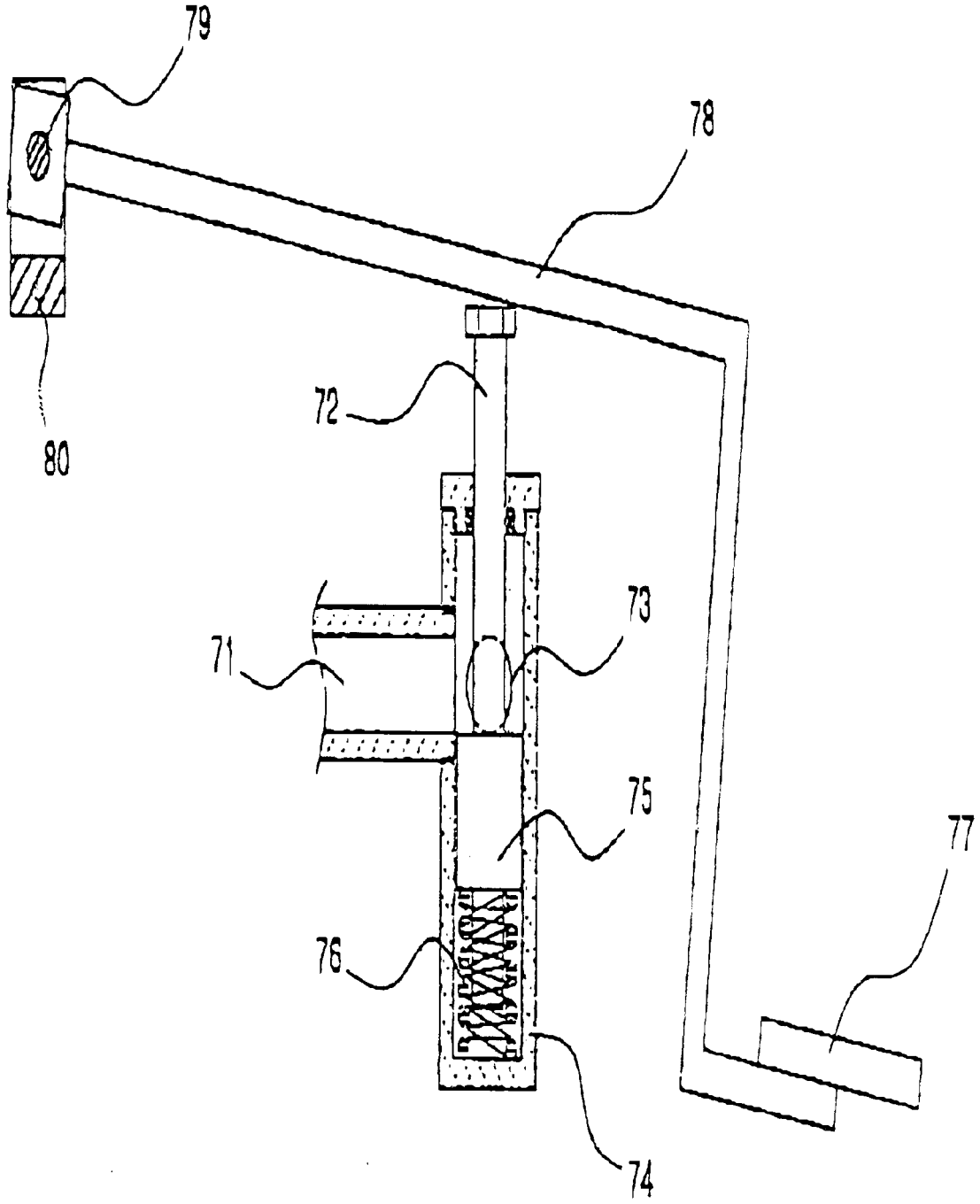

According as the piston 72 is lowered, the plunger 75 is lowered, to thereby water be spewed out from the inputting pipe 71 to the outputting pipe. At this point, if the footboard 77 is half pressed, as shown in FIG. 7*b*, the plunger 75 is suspended half of the inputting pipe 71. If the footboard 77, 77' is pressed completely, as shown in FIG. 7*c*, the plunger 75 is lowered to the bottom and the flow rate is at maximum.

If a uses wants to stop the water, the footboard 77 is back to the original position by detaching the foot from it and the plunger 75 is back to the original position by elasticity of the spring 76. As shown in FIG. 7*a*, then the opening of the inputting pipe 71 is cut off completely and no more flow take places. Therefore, water does not spewed out.

Operation of using cold water is same manner with warm water. Therefore, the explanation is omitted.

In case a user wants to use warm and cold water together, the footboard 77, 77' is pushed simultaneously and the piston 72, 72' linked to the lever 78 is lowered.

According as the piston 72, 72' is lowered, the plunger 75 is lowered, to thereby water be spewed out from the inputting pipe 71 to the outputting pipe. At this point, if the footboard 77, 77' is half pressed, as shown in FIG. 7*b*, the plunger 75 is suspended half of the inputting pipe 71. The operation when the footboard 77, 77' is pressed completely and a foot is detached from the footboard 77, 77', are same with those of warm water.

INDUSTRIAL APPLICABILITY

As described hereinbefore, the present invention provides a water supply operated by a foot, which no need to worry about staining a faucet with hands and no need to stop ongoing work with hands in the kitchen and a problem of waste of water caused by delaying closing the faucet owing to inconvenience is solved by a foot operation The present Invention will be very useful in the water supply manufacturing industry, contributing to the convenience in the kitchen, improving efficiency of work and saving water.

What is claimed is:

1. A water supply operated by a foot, characterized in main body of a sink water supply is moved to the lower part of the six and an outputting pipe 52 is lengthened, to thereby be placed over the sink, in said sink water supply comprises said water supply 53, which a ceramic cartridge 92 is inserted at the inside of said water supply 53, to thereby warm or cold water is selected by rotating a regulating bar 51 in left/right direction and the flow rate of water is regulated according to pushing degree of said regulating bar 51.

2. The water supply as set forth in claim 1, wherein said regulating bar 51 is formed in the similar shape of the fore part of shoes to thereby, facilitate to move a foot.

3. The water supply as set forth in claim 1, characterized in: said ceramic cartridge 92 inserted at the inside of said water supply 53 is laid horizontally;

an operating pedal 54 is fixed to lever 81;

a upper plate of said operating pedal 54 has constant thickness;

the flow rate of water is regulated according to pushing degree by 'A' portion of said operating pedal 54; and warm or cold water is selected depending on a selection of 'C' portion or 'D' portion.

* * * * *